United States Patent [19]

Iwata

[11] Patent Number: 4,971,010

[45] Date of Patent: Nov. 20, 1990

[54] METHOD AND APPARATUS FOR MISFIRING DETECTION AND CONTROL IN AN INTERNAL COMBUSTION ENGINE

[75] Inventor: Toshio Iwata, Himeji, Japan

[73] Assignee: Mitsubishi Denki Kabushiki Kaisha, Tokyo, Japan

[21] Appl. No.: 420,065

[22] Filed: Oct. 11, 1989

[30] Foreign Application Priority Data

Oct. 12, 1988 [JP] Japan ..... 63-254764

[51] Int. Cl.[5] ..... F02M 7/00; F02P 5/14; F02D 7/00

[52] U.S. Cl. ..... 123/435; 123/425; 123/440; 123/481

[58] Field of Search ..... 123/481, 425, 478, 435, 123/440, 332, 333, 489, 479; 364/431.04, 431.05, 431.08

[56] References Cited

U.S. PATENT DOCUMENTS 4,006,718 2/1977 Konomi ..... 123/479
4,305,364 12/1981 Stuckas ..... 123/440
4,409,936 10/1983 Dozono ..... 123/481
4,499,876 2/1985 Yamamoto ..... 123/481
4,825,836 5/1989 Hirose ..... 123/425
4,903,665 2/1990 Washino et al. ..... 123/435

*Primary Examiner*—Raymond A. Nelli
*Attorney, Agent, or Firm*—Sughrue, Mion, Zinn, Macpeak and Seas

[57] ABSTRACT

A control apparatus for an internal combustion engine has a misfiring sensor 1 which senses the number of cylinders which are not firing based on the exhaust gas temperature of the engine. When the misfiring sensor detects that a cylinder is not firing, a microcomputer 2,3 temporarily shuts off the supply of fuel to each cylinder is succession and monitors changes in the output of the misfiring sensor. If the output of the misfiring sensor does not change when the fuel supply to a cylinder is temporarity cut off, that cylinder is determined to be misfiring, and the microcomputer cuts off the supply of fuel to the misfiring cylinder.

5 Claims, 3 Drawing Sheets

METHOD AND APPARATUS FOR MISFIRING DETECTION AND CONTROL IN AN INTERNAL COMBUSTION ENGINE

BACKGROUND OF THE INVENTION

This invention relates to a method and apparatus for an internal combustion engine which can detect when a cylinder of the engine is misfiring and cut off the supply of fuel to the misfiring cylinder while allowing the remaining cylinders to continue to operate.

When a cylinder of an internal combustion engine misfires, uncombusted fuel and air are discharged from the engine. When the uncombusted fuel and air reach the catalytic converter for the engine, a sudden chemical reaction takes place, causing a great increase in the temperature of the catalytic converter. In this state, the catalytic converter can not function properly, and harmful exhaust gases are discharged into the atmosphere. The large increase in temperature also produces damage or degradation of the catalytic converter and shortens its life span. Furthermore, when an automobile is stationary, if dead grass or other combustible material should contact the catalytic converter when it is at an abnormally high temperature due to misfiring, there is the possibility of a fire starting.

SUMMARY OF THE INVENTION

Accordingly, it is an object of the invention to provide a method and apparatus for an internal combustion engine which can detect misfiring of any cylinder of the engine and stop the supply of fuel to the misfiring cylinder while allowing the engine to continue running on the cylinders which are functioning normally.

When a cylinder of an engine misfires, the temperature of the exhaust gas of the engine decreases. The greater the number of misfiring cylinders, the greater is the temperature decrease. A misfiring cylinder can be detected by comparing the exhaust gas temperature with a reference temperature which is a function of the engine rotational speed and the intake air pressure. When the occurrence of misfiring is detected, the specific cylinder which is misfiring can be identified by successively cutting off the supply of fuel to each cylinder one at a time and detecting whether doing so produces a change in the exhaust gas temperature. If the fuel supply is cut off to a cylinder which is not misfiring, the exhaust gas temperature of the engine will further decrease. On the other hand, if the fuel supply is cut off to a cylinder which is misfiring, there will be no change in the exhaust gas temperature, so the misfiring cylinder can be identified.

A control apparatus for an internal combustion engine according to the present invention includes a misfiring sensor for sensing a misfiring cylinder on the basis of an engine operating parameter, such as the exhaust gas temperature, which varies with the number of misfiring cylinders. A first fuel control means temporarily stops the supply of fuel to each cylinder of the engine in succession when the misfiring sensor senses the presence of a cylinder which is not firing. A cylinder recognizing means recognizes a misfiring cylinder based on a change in the output signal of the misfiring sensor when the fuel supply to a cylinder is stopped by the first fuel control means. A second fuel control means then stops the supply of fuel to a cylinder which is recognized by the cylinder recognizing means.

In a preferred embodiment, the first and second fuel control means and the cylinder recognizing means are constituted by a microcomputer.

DESCRIPTION OF THE PREFERRED EMBODIMENT

Figure 1:
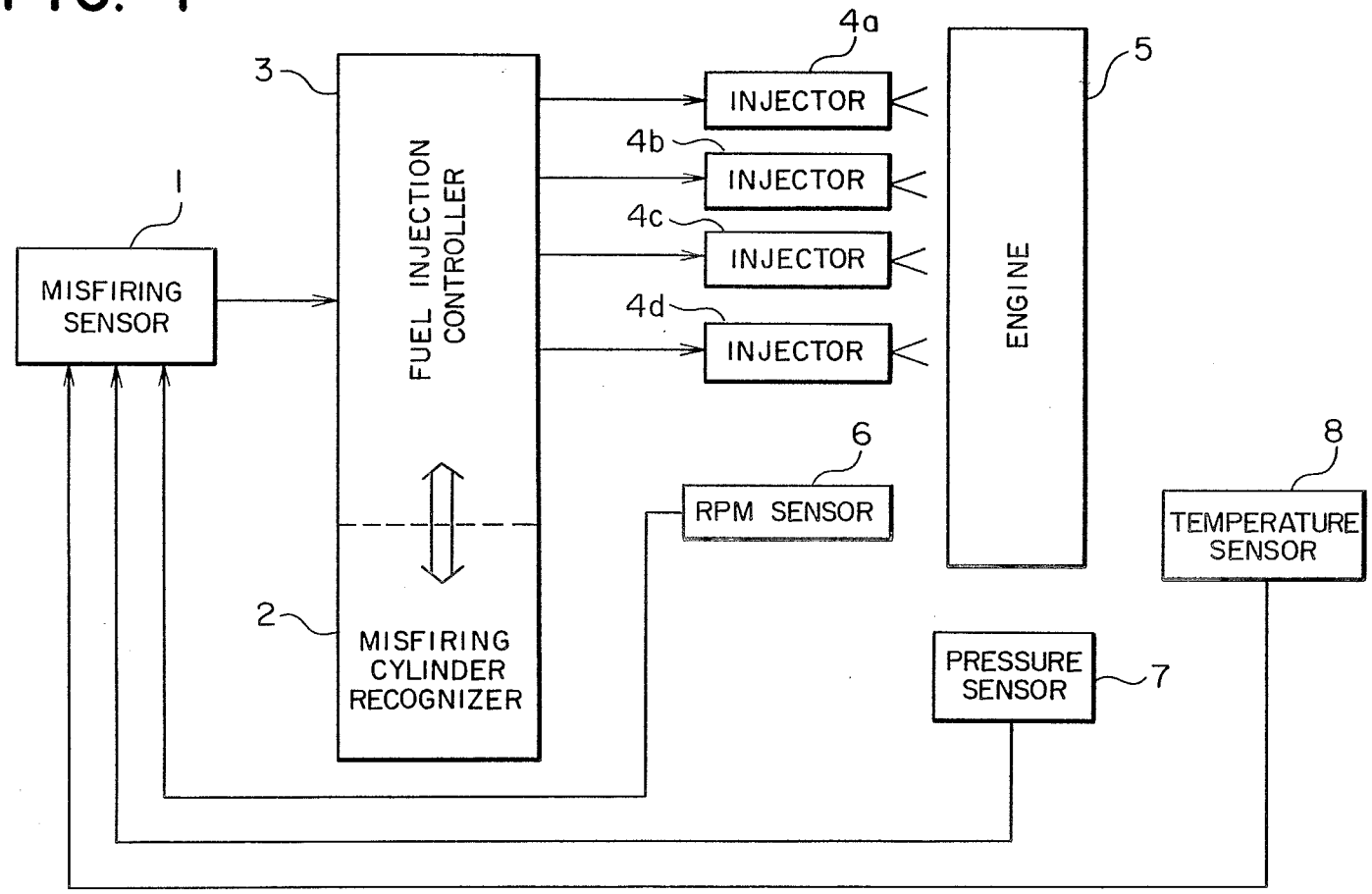
FIG. 1 is a block diagram of an embodiment of a control apparatus according to the present invention.

A preferred embodiment of a control apparatus for an internal combustion engine according to the present invention will now be described while referring to the accompanying drawings. FIG. 1 is a block diagram of this embodiment as applied to a four-cylinder engine 5, although the number of cylinders is arbitrary. Each cylinder of the engine 5 is equipped with a corresponding fuel injector **4*a*–4*d*, respectively. The rotational speed, the intake air pressure, and the exhaust gas temperature of the engine 5 are sensed by a rotational speed sensor 6, a pressure sensor 7, and a temperature sensor 8, respectively. These sensors generate output signals which are provided to a misfiring sensor 1, which senses misfiring of the engine 5 on the basis of the output signals from the sensors 6–8. The misfiring sensor 1 generates an output signal indicating the number of cylinders which are not firing for any reason. This output signal is provided to a fuel injection controller 3 which controls the operation of the fuel injectors 4*a*–4*d*, and to a misfiring cylinder recognizer 2 which recognizes which cylinder is misfiring on the basis of the output signal from the misfiring sensor 1. The fuel injection controller 3 operates in response to control signals from both the misfiring sensor 1 and the misfiring cylinder recognizer 2. The controller 3 constitutes a first fuel control means for temporarily stopping the supply of fuel to each cylinder of the engine in succession when the misfiring sensor senses the presence of a cylinder which is not firing, and a second fuel control means for stopping the supply of fuel to a cylinder which is recognized by the recognizing means. The misfiring cylinder recognizer 2 and the fuel injection controller 3** are preferably constituted by a microcomputer.

Figure 4:
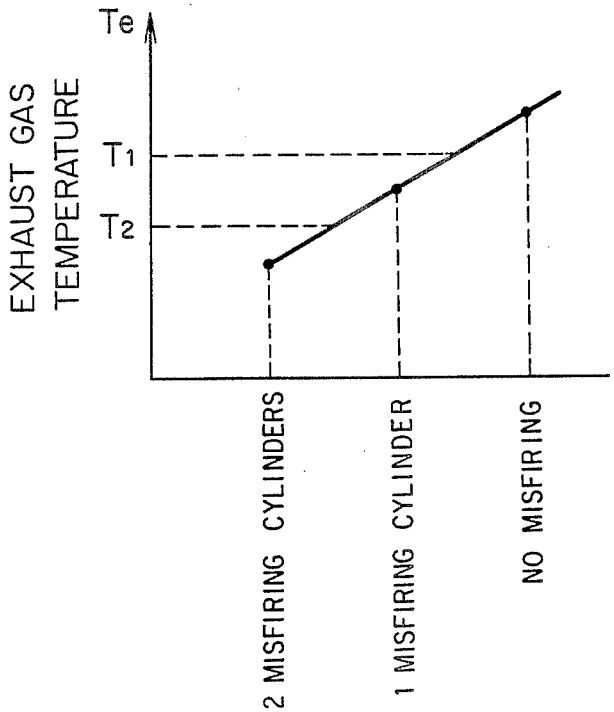
FIG. 4 is a graph of the relationship between the exhaust gas temperature of an engine and the number of misfiring cylinders.

As mentioned earlier, misfiring of a cylinder can be detected by sensing the exhaust gas temperature of an engine. FIG. 4 shows the relationship between the exhaust gas temperature Te and the number of misfiring cylinders. From this graph, it can be seen that the exhaust gas temperature Te decreases as the number of misfiring cylinders increases, and the number of misfiring cylinders can be determined by comparing the exhaust gas temperature Te with reference temperatures T1 and T2. If the exhaust gas temperature Te is greater than T1, then all of the cylinders are firing normally. If Te is between T1 and T2, then one cylinder is misfiring, while if Te is less than T2, two cylinders are misfiring. The reference temperatures T1 and T2 are functions of the engine intake air pressure P and the engine rotational speed $n_e$. The relationship between the reference temperatures T1 and T2, the pressure P, and the rotational speed $n_e$ can be easily determined empirically and then stored in a look-up table in an unillustrated engine controller for access by the misfiring sensor 1.

The misfiring sensor 1 generates an output signal having a different value depending upon the number of cylinders which it detects to be misfiring, as determined by the value of the exhaust gas temperature Te relative to the reference temperatures T1 and T2.

The operation of the embodiment of FIG. 1 will be described while referring to FIGS. 2 and 3, which are flow charts of a routine process for recognizing a misfiring cylinder and a routine for stopping the supply of fuel to the misfiring cylinder. First, in Step S1 of FIG. 2, it is determined whether the intake air pressure P which is measured by the pressure sensor 7 is less than a reference pressure Po. If it is not, then it is determined that the engine is operating in a high load region, so the subsequent steps are skipped and a return is performed. If the pressure P is less than the reference pressure Po, then in Step S2, it is determined whether the exhaust gas temperature Te which is sensed by the temperature sensor 8 is less than the first reference temperature T1 of FIG. 4, which is a function of the engine rotational speed ne and the intake air pressure P. The first reference temperature T1 is determined based on the output signals from the rpm sensor 6 and the pressure sensor 7 by referring to a look-up table. If Te is not less than T1, then it is determined that no misfiring is taking place and a return is performed. However, if Te<T1, it is determined that at least one cylinder is misfiring, so in Step S3, a counter n which is used for counting the cylinders is set equal to 0, and in Step S4, the counter is incremented by 1. (It will be assumed that only one cylinder of the engine is misfiring, so the misfiring sensor 1 generates an output signal indicating the misfiring of a single cylinder).

In Step S5, the fuel injector for cylinder #n is temporarily prevented from supplying fuel (for one cycle of the engine, for example), and the exhaust gas temperature Te is again measured. In Step S6, the exhaust gas temperature Te is compared with the second reference temperature T2 of FIG. 4, which is a function of the rotational speed $n_e$ and intake air pressure P and which is determined by reference to a look-up table in the same manner as for the first reference temperature T1.

If cylinder #n is misfiring, then cutting off its fuel supply in Step S5 will have no effect on the exhaust gas temperature Te, so the exhaust gas temperature Te will be greater than T2 and the output of the misfiring sensor 1 will be unchanged. On the other hand, if cylinder #n is operating normally, temporarily cutting off its fuel supply will further decrease the exhaust gas temperature Te to below T2. The misfiring sensor 1 can not distinguish between a fall in temperature due to actual misfiring and a fall in temperature due to the supply of fuel being cut off to a cylinder. Therefore, when the exhaust gas temperature Te falls below T2, the misfiring sensor 1 generates an output signal indicating that two cylinders are misfiring.

Accordingly, in Step S6, if Te is not less than T2, it is determined that cylinder #n is misfiring, and in Step S7, the nth bit of a misfiring cylinder recognition register K(n) is set equal to 1, and then Step S8 is proceeded to. On the other hand, if in Step S6 it is determined that Te is less than T2, the routine proceeds directly to Step S8.

In Step S8, it is determined whether n is greater than or equal to 4. If it is, then all of the cylinders have been checked (since there are four cylinders), and a return is performed. If n is less than 4, then the routine goes back to Step S4, and Steps S4–S7 are repeated until all the cylinders have been checked for misfiring.

Figure 2:
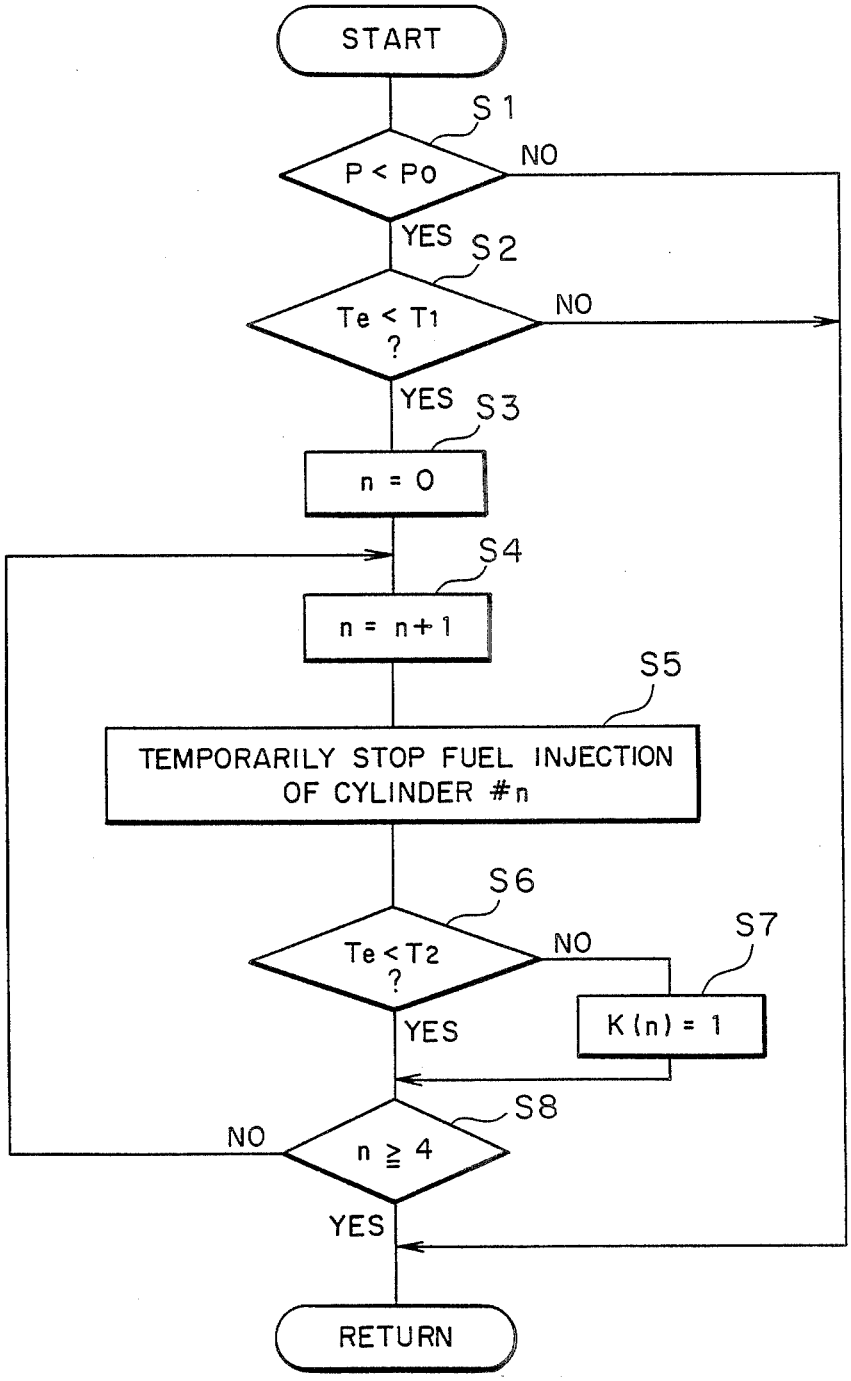
FIG. 2 is a flow chart of the operation of the embodiment of FIG. 1 when identifying a misfiring cylinder.
Figure 3:
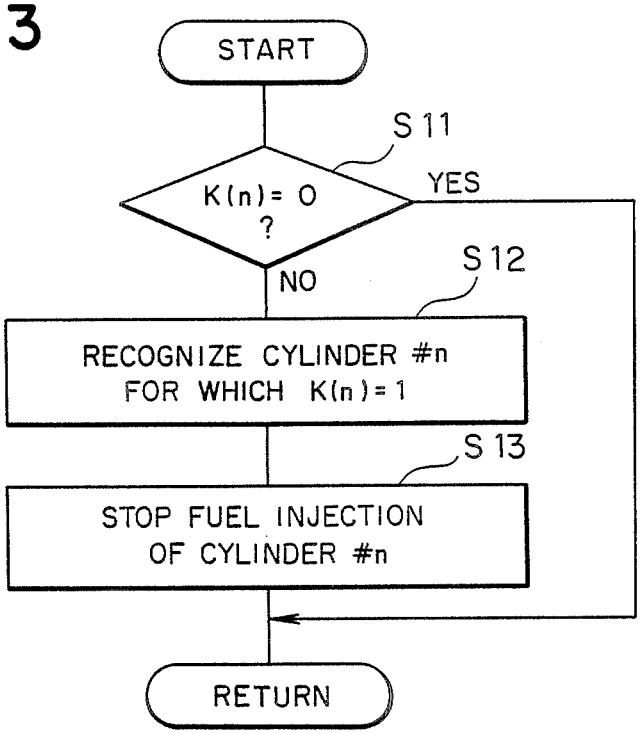
FIG. 3 is a flow chart of a routine performed by the embodiment of FIG. 1 for stopping the supply of fuel to a misfiring cylinder.

After the routine of FIG. 2 has been performed, the fuel injection controller 3 performs the routine of FIG. 3 to stop the supply of fuel to the misfiring cylinder. In Step S11 of FIG. 3, it is checked whether the misfiring cylinder recognition register K(n) is equal to 0. If it is, then it is determined that none of the cylinders are misfiring, and a return is performed. If it is not equal to 0, then in Step S12, it is determined which bit of the recognition register K(n) is equal to 1. Since cylinder #n is misfiring, the nth bit is equal to 1, so in Step S13, the fuel injector for cylinder #n is stopped, and a return is then performed.

In this manner, the fuel injector for a misfiring cylinder is prevented from supplying fuel to a misfiring cylinder, while the other cylinders of the engine can continue to function normally. Thus, uncombusted fuel can be prevented from entering the catalytic converter, and the catalytic converter can be prevented from discharging harmful gases to the atmosphere and from being degraded by sudden chemical reactions with the uncombusted fuel. The danger of fires due to the catalytic converter being heated to a high temperature and coming into contact with dead grass or other combustible material is also prevented.

What is claimed is:

1. A misfiring sensing, identification and control apparatus for a multi-cylinder internal combustion engine, comprising:

a misfiring sensor for sensing the number of a total plurality of cylinders of the engine which are not firing based on a degree of decrease of the exhaust gas temperature of the engine;

first fuel control means for temporarily interrupting the supply of fuel to each cylinder of the engine in succession when the misfiring sensor senses the presence of at least one cylinder which is not firing;

cylinder identification means for identifying the misfiring cylinder or cylinders based on a change in the number of cylinders which the misfiring sensor senses are not firing when the fuel supply to a cylinder is temporarily interrupted; and second fuel control means for permanently terminating the supply of fuel to each cylinder which is identified by the identification means.

2. An apparatus as claimed in claim 1, wherein the misfiring sensor comprises means for comparing the exhaust gas temperature of the engine with a reference temperature which is a function of the rotational speed and intake air pressure of the engine.

3. A method for sensing misfiring, identifying a misfiring cylinder and controlling a multi-cylinder internal combustion engine, comprising:

sensing the value of the exhaust gas temperature of the engine which decreases in value as the number of misfiring cylinders increases;

sensing misfiring by comparing the sensed value of the exhaust gas temperature with a reference value;

temporarily interrupting the supply of fuel to each cylinder of the engine in succession when misfiring is sensed;

determining whether there is change in the sensed value of the exhaust gas temperature when the fuel supply to a given cylinder is temporarily interrupted;

determining that the given cylinder is misfiring if the sensed value of the exhaust gas temperature increases when the fuel supply to the given cylinder is temporarily interrupted; and permanently cutting off the supply of fuel to the given cylinder if it is determined to be misfiring.

4. A method as claimed in claim 3, wherein the reference value is a first reference temperature which is a function of the rotational speed and the intake air pressure of the engine.

5. A method as claimed in claim 4, wherein the step of determining that the given cylinder is misfiring comprises comparing the sensed value of the exhaust gas temperature with a second reference temperature which is a function of the engine rotational speed and the intake air pressure and which is lower than the first reference temperature.

* * * * *